United States Patent [19]

Kobayashi et al.

[11] 4,250,905

[45] Feb. 17, 1981

[54] COIN DISPENSING MACHINE

[75] Inventors: Osamu Kobayashi, Sakado; Kohji Yukimoto; Hiroshi Hayashi, both of Kawagoe, all of Japan

[73] Assignee: Nippon Coinco Co., Ltd., Tokyo, Japan

[21] Appl. No.: 952,817

[22] Filed: Oct. 19, 1978

[30] Foreign Application Priority Data

Oct. 21, 1977 [JP] Japan ..... 52-141586[U]

[51] Int. Cl.[3] ..... G07D 1/00

[52] U.S. Cl. ..... 133/5 R; 221/125

[58] Field of Search ..... 133/4 R, 4 A, 5 R, 2; 221/125, 129, 131, 13, 94

[56] References Cited

U.S. PATENT DOCUMENTS

| | | | |
|---|---|---|---|
| 2,204,853 | 6/1940 | Goodman | 133/5 R X |
| 2,610,721 | 9/1952 | Pruyn | 133/4 R X |
| 3,131,702 | 5/1964 | Buchholz et al. | 133/4 R |
| 3,245,581 | 4/1966 | Reach | 221/129 X |

FOREIGN PATENT DOCUMENTS

| | | | |
|---|---|---|---|
| 1369213 | 10/1974 | United Kingdom | 221/13 |

*Primary Examiner*—F. J. Bartuska

*Attorney, Agent, or Firm*—Spensley, Horn, Jubas & Lubitz

[57] ABSTRACT

A coin dispensing machine capable of selectively dispensing a coin of a predetermined denomination from among coins of various denominations stored in a plurality of coin tubes. Coins placed at the bottom of the respective coin tubes (i.e. the lowermost coins in stacks of coins in the respective coin tubes) are taken out of the coin tubes by means of a pay out slide. A single coin only among the taken out coins nominated by selective energization of two solenoids is allowed to drop below while the coins which have not been selected are returned to the coin tubes. The dropped coin is then introduced into an outlet by a wiping operation of one or two wipers.

13 Claims, 17 Drawing Figures

COIN DISPENSING MACHINE

BACKGROUND AND SUMMARY OF THE INVENTION

This invention relates to coin dispensing machines.

In a conventional coin dispensing machine, a sector-shaped operating plate 1 as shown in FIG. 1 is placed below two coin tubes. The operating plate 1 is turned in the direction of the arrow A or A' by an electric motor (not shown), so that when a hole 1*a* or 1*b* formed in the operating plate 1 is aligned with one coin tube from which coins are to be dispensed, the coins contained in the coin tube are discharged through the hole 1*a* or 1*b*.

However, with the operation plate, it is impossible to subject more than two coin tubes to coin dispensation because of its construction. Therefore, in the case where a number of coin tubes are juxtaposed, one operating plate should be provided for every two coin tubes, and these operating plates must be driven individually. Accordingly, it is necessary to provide a number of driving electric motors, and the dispensing mechanism is necessarily intricate. Therefore, it is rather difficult to assemble the conventional dispensing machine, and therefore the machine is expensive. In addition, it is difficult to install a number of driving motors in view of the space occupied by them, and accordingly, the number of coin tubes which can be juxtaposed is limited. If the number of coin tubes which can be juxtaposed is small, naturally the amount of coins stored is reduced as much, which may cause the shortage of change. In addition, when the number of monetary denominations required is increased, it is difficult to deal with it.

In view of the above-described drawbacks accompanying a conventional coin dispensing machine, an object of this invention is to provide a coin dispensing machine in which desired coins are selectively dispensed out of a plurality of juxtaposed coin tubes.

DETAILED DESCRIPTION OF THE INVENTION

As conductive to a full understanding of this invention, first a coin dispensing machine according to the invention will be briefly described.

Figures 1, 2:
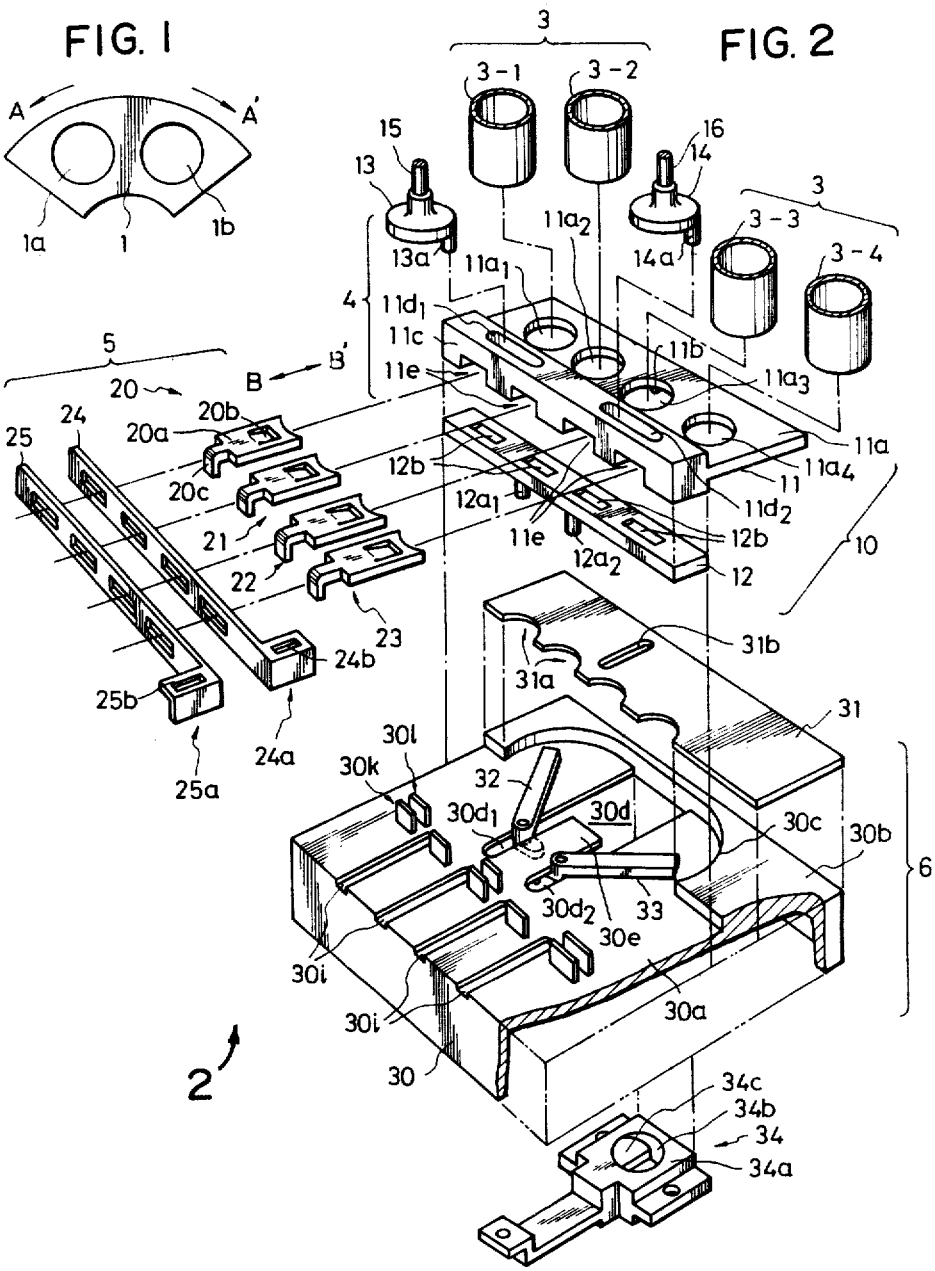
FIG. 1 is a diagram showing an outline of a conventional coin dispensing mechanism.
FIG. 2 is a perspective view, partly cut away, showing one example of a coin dispensing machine according to this invention.

Shown in FIG. 2 is one example of the coin dispensing machine 2 which comprises a coin taking-out mechanism section 4, a coin selection control section 5 and a coin dispensing mechanism section. The coin taking-out mechanism section section 4 is below a plurality of juxtaposed coin tubes 3. In this section 4, the coins at the bottoms of the coin tubes 3 are received in holes $\mathbf{11}a_1$ through $\mathbf{11}a_4$, respectively, and are removed from the coin tubes 3 by shifting them in the direction of the arrow B by means of cams 13 and 14. In the coin selection control section 5, the movements of change slides 20 through 23 adapted to temporarily support the coins in the holes when the coins are taken out of the coin tubes are controlled by change levers 24 and 25 thereby to allow only predetermined dispensing coins to drop through the holes. In the coin dispensing mechanism section 6, the coins dropped through the holes are introduced to a predetermined position by means of wipers 32 and 33 so that the coins are dispensed through a dispensing hole 34*a*. Thus, the coins in the coin tubes are selectively dispensed out of the machine.

The coin taking-out mechanism section 4 comprises; a pay out slide 10 adapted to take coins out of the coin tubes; and the aforementioned cams 13 and 14 driving the pay out slide 10. The pay out slide 10 is made up of an upper pay out slide 11 and a lower pay out slide 12. In the flat plate section 11*a* of the upper pay out slide 11, there are formed, for instance, four aforementioned holes $\mathbf{11}a_1$ through $\mathbf{11}a_4$ in correspondence to the number of coin tubes juxtaposed. The thickness of the flat plate section 11*a* is equal to that of coins, and the diameter of each hole ($\mathbf{11}a_1$–$\mathbf{11}a_4$) is slightly larger than the diameter of coins. A protruded section 11*b* is provided on the bottom of the flat plate section 11*a*. One side section 11*c* of the flat plate section 11*a* is thicker than the remaining portion thereof. Grooves $\mathbf{11}d_1$ and $\mathbf{11}d_2$ are formed in the upper surface of the one side section 11*c*, and grooves 11*e* are formed in the lower surface of the same in correspondence to the holes $\mathbf{11}a_1$ through $\mathbf{11}a_4$.

Protruded sections $\mathbf{12}a_1$ and $\mathbf{12}a_2$ are provided on the lower surface of the lower pay out slide at a predetermined interval, while through-shaped grooves 12*b* are formed in the upper surface of the lower pay out slide 12 in correspondence to the grooves 11*e* in the upper pay out slide 11. The upper surface of the lower pay out slide 12 is brought into close contact with the lower surface of the one side section 11*c* (hereinafter referred to as a thick wall section 11*c*, when applicable) of the upper pay out slide 11 to form the pay out slide 10. The grooves 11*e* substantially form holes by fixedly securing the lower pay out slide 12 to the upper pay out slide 11. The holes thus formed will be referred to as holes 11*e* hereinafter.

The cam 13 is like a disk, and has a protrusion 13*a* on the peripheral portion of the bottom thereof. This protrusion 13a can move along the groove 11d$_1$ of the pay out slide 10 with a slight air gap therebetween. The configuration of the cam 14 is completely similar to that of the cam 13. These cams 13 and 14 are fixedly fastened to respective shafts 15 and 16, which are coupled to a gear box (not shown). The cams 13 and 14 are rotated in the opposite directions by a driving motor (not shown) in synchronization with each other, thereby to drive the pay out slide in the directions of the arrow B or B'.

Figure 3:
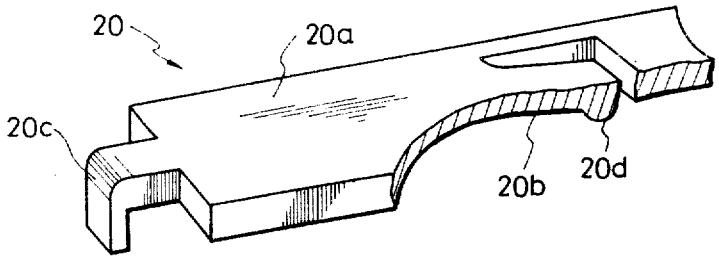
FIG. 3, FIG. 4, FIG. 5*a* and FIG. 5*b* are explanatory diagrams showing parts used in the machine shown in FIG. 2.
Figure 6:
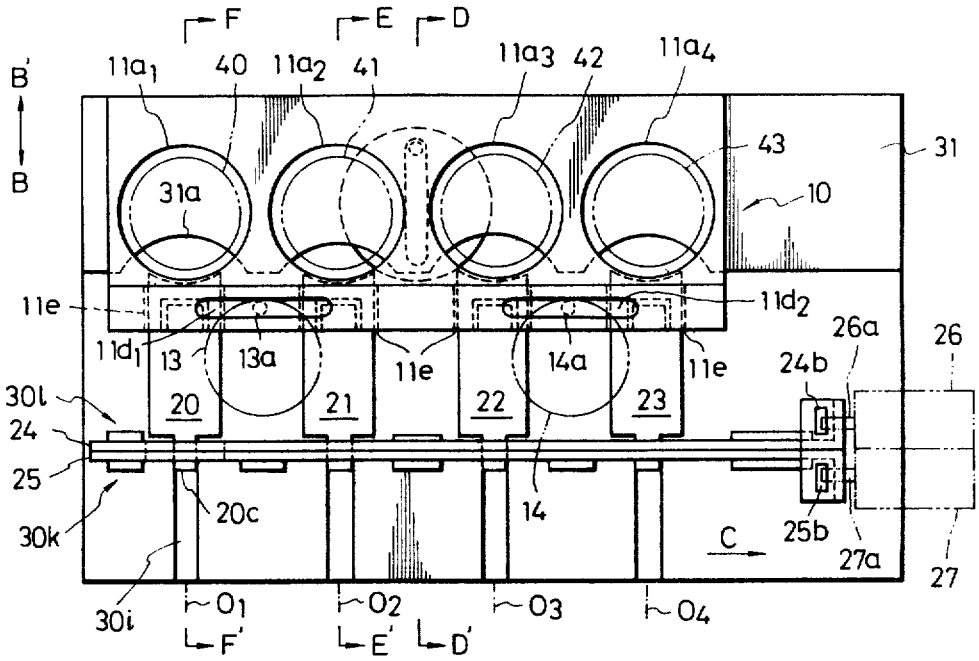
FIG. 6 is a plan view showing the assembly of the coin dispensing machine shown in FIG. 2.

The coin selection control section 5 comprise the change slides 20 through 23, the change levers 24 and 25, and solenoids 26 and 27 (FIG. 6). The change slides 20 through 23 are to temporarily support the coins received in the holes 11a$_1$ through 11a$_4$ of the pay out slide 10. A tongue 20b is formed by stamping three sides thereof in the body 40a of the change slide 20. A substantially "L"-shaped locking part 20c is provided on one end of the body 20a. The size of the body 20a is such that the body 20a can pass through the hole 11e of the pay out slide 11 with a slight air gap therebetween. The thickness of the tongue 20b is smaller than that of the body 20a as shown in FIG. 3, and a strip 20d is protruded from the end portion of the bottom of the tongue 20b so that it is engaged with the groove 12b in the pay out slide 10. The change slide 20 is formed as one unit with synthetic resin. The tongue 20b is bent by depressing the protruded strip 20d, and it is restored by releasing the strip 20d. The remaining change slides 21 through 23 are similar in construction as the change slide 20.

The change slides 20 through 23 are inserted into the holes 11e in the pay out slide 10 so that the protruded strips 20d through 23d (the protruded strips 21d through 23d being not shown) are engaged with the grooves 11e. Therefore, the change slides 20 through 23 are moved as the pay out slide 10 moves.

Figure 4:
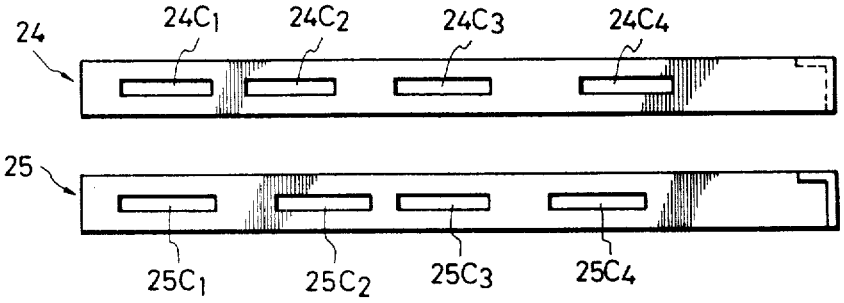

The change levers 24 and 25 are to control the follow movements of the change slides 20 through 23. End portions 24a and 25a of the change levers 24 and 25 are bent through about right angles. Holes 24b and 25b are formed in the upper surfaces of the change levers 24 and 25, respectively. Furthermore, holes 24c$_1$ through 24c$_4$ and holes 25c$_1$ through 25c$_4$ are formed at predetermined positions in the change levers 24 and 25, respectively as shown in FIG. 4. The size of these holes 24c$_1$-25c$_4$ is equal to the size of the holes 11e in the pay out slide 10. The locking parts 20c through 23c of the changes slides 20 through 23 are inserted into the holes 24c$_1$-24c$_4$ and 25c$_1$-25c$_4$ of the change levers 24 and 25, respectively. The change levers 24 and 25 are coupled through the holes 24b and 25b to the shafts 26a and 27a of the solenoids 26 and 27, respectively, as shown in FIG. 6. The solenoids 26 and 27 operate to move the change levers 24 and 25 individually in the direction of the arrow C.

Figure 7:
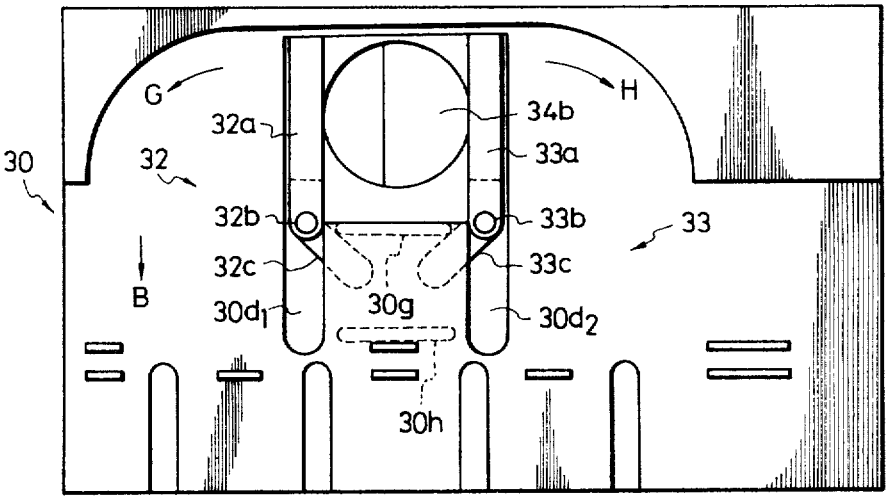
FIG. 7 is also a plan view showing the coin dispensing machine shown in FIG. 2 with the upper parts removed.
Figure 13:
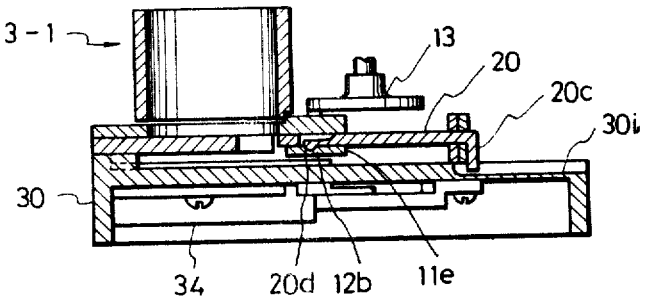

The coin dispensing mechanism section 6 comprises a bottom base 30, a base plate 31, the wipers 32 and 33, and a detector 34. The bottom base 30 is the base of the coin dispensing machine 2. A step-like base part 30b is provided on one side of the upper surface 30a of the bottom base 30, and has a semi-elliptic cut 30c as shown in FIG. 2. A substantially "U"-shaped hole 30d is formed at a predetermined position in the upper surface 30a, leaving a tongue 30e. Protruded strips 30g and 30h are provided at the top and base portions of the bottom surface of the tongue 30e, respectively, as shown in FIG. 7. Grooves 30i are provided at predetermined positions on the upper surface 30a in correspondence to the holes 11e of the above-described pay out slide 10. The locking parts 20c through 23c of the change slides 20 through 23 are engaged with the grooves 30i, respectively, as shown in FIG. 13. Furthermore, guides 30k and 30l are juxtaposed at predetermined intervals on the upper surface 30a, so as to slidably support the change levers 24 and 25 placed on the upper surface 30a of the bottom base 30.

The base plate 31 is to support the coins in the coin tubes, and has substantially the same size as that of the base part 30b. The base plate 31 has arc-shaped cuts 31a at positions corresponding to the holes 11a$_1$ through 11a$_4$ of the pay out slide 10, on one side thereof. The base plate 31 further has a slit 31b as shown in FIG. 2. The base plate 31 is fixedly placed on the base part 30b of the bottom base 30.

Figure 5:
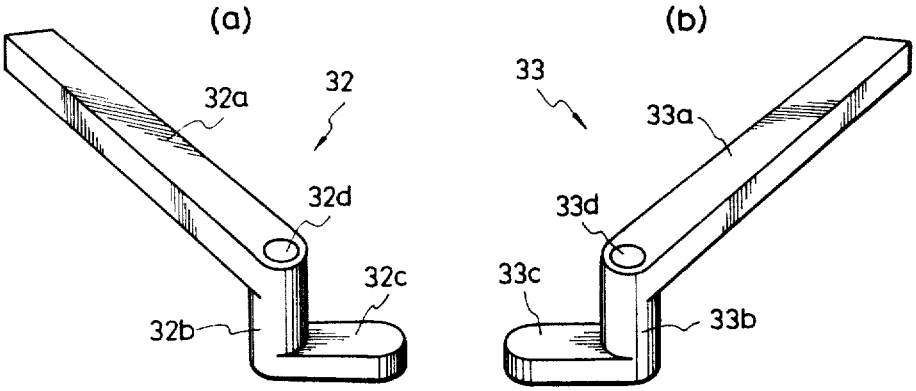

The wipers 32 and 33 operate to introduce coins dropped on the upper surface 30a of the bottom base 30 to the dispensing hole. The wiper 32 is substantially in the form of a crank as shown in the part (a) of FIG. 5, comprising an arm part 32a, a locking part 32c and a shaft part 32b. The arm part 32a is connected through the shaft part 32b to the locking part 32c in such a manner that the arm part 32a is in parallel with the locking part 32c and the former 32a forms an angle with the latter 32c. The diameter of the shaft part 32b is such that the shaft part 32b can slidably move in a slit 30d$_1$ of the hole 30d. The thickness of the arm part 32a is smaller than that of the base part 30b of the bottom base 30 so that the arm part 32a can smoothly slide on the upper surface 30a of the bottom base. The shaft part 32b has a hole 32d axially into which the protrusion 12a$_1$ of the pay out slide 10 is rotatably inserted. As is apparent from comparison of the parts (a) and (b) of FIG. 5, the wiper 33 is symmetrical with the wiper 32.

These wipers 32 and 33 are arranged so that the arm parts 32a and 33a are placed on the bottom base upper surface 30a, the shaft parts 32b and 33b are inserted into the slide 30d$_1$ and 30d$_2$ of the hole 30d, and the locking parts 32c and 33c are placed between the protruded strips 30g and 30h and under the tongue 30e. Then, the pay out slide 10 is placed on the base plate 31 in such a manner that the protrusion 11b is inserted into the slit 31b and the protrusions 12a$_1$ and 12a$_2$ are inserted respectively into the holes 32d and 33d of the wipers 32 and 33. The protrusion 11b is engaged with the slit 31b so that the pay out slide 10 can moved in the direction of the arrow B or B' without staggering on the base plate 31.

The detector 34 operates to detect coins dispensing. The detecting part 34a of the detector 34 has a hole 34b. This hole 34b has a circular inlet side, an outlet side whose opening is about 60% of the opening of the inlet side, and a closed part 34c sloped from the inlet side toward the outlet side. A coin introduced through the inlet side is moved along the sloped surface of the closed part 34c and is then discharged through the outlet side. Coins are discharged in the same posture at all times, which is effective for preventing the detection error. An annular groove 34d (FIG. 11) coaxial with the hole 34b is formed in the bottom of the detecting part 34a, and a detecting coil 35 is inserted in the annular groove 34d. The detecting coil 35 is to detect a coin passing through the hole 34b. The detecting part 34a of the detector 34 is inserted into the hole 30d of the bottom base 30, and is then secured to the bottom base 30 with a screw as shown in FIGS. 11-13.

Thus, the coin dispensing machine 2 has been constructed.

FIG. 6 is a plan view showing the assembly of the coin dispensing machine shown in FIG. 2. The centers of the holes $11a_1$ through $11a_4$ and holes 11*e* of the pay out slide 10 and the centers of the cuts 31*a* of the base plate 31 are aligned with the centers $O_1$ through $O_4$ (indicated by the chain lines) of the grooves 30*i* of the bottom base 30. The protrusions 13*a* and 14*a* of the cams 13 and 14 are substantially at the centers of the grooves $11d_1$ and $11d_2$ of the pay out slide 10, respectively. When the cams 13 and 14 are placed in the rotation state, the pay out slide 10 is slid to the maximum shift position in the direction of the arrow B' on the base plate 31. Under this condition, the protruded strip 20*d* (FIG. 3) formed on the tongue 20*b* of the change slide 20 is engaged with the groove 12*b* in the bottom of the hole 11*e* of the pay out slide 10. Similarly, the other changes slides 21 through 23 are engaged with the holes 11*e* of the pay out slide 10. The upper surfaces of the bodies of the change slides 20 through 23 are flush with the upper surface of the base plate 31. The top ends of the change slides 20 through 23 are aligned with the holes $11a_1$ through $11a_4$ of the pay out slide 10, respectively.

Figure 11:
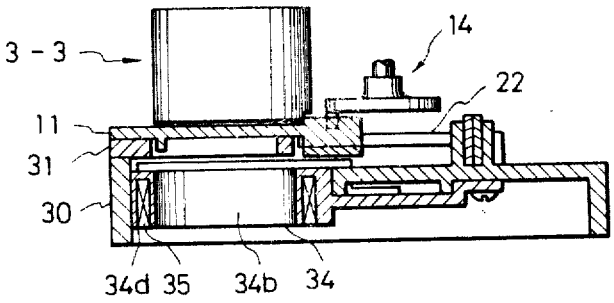
FIGS. 11, 12 and 13 are sectional views taken along lines D—D', E—E', and F—F' in FIG. 6.
Figure 12:
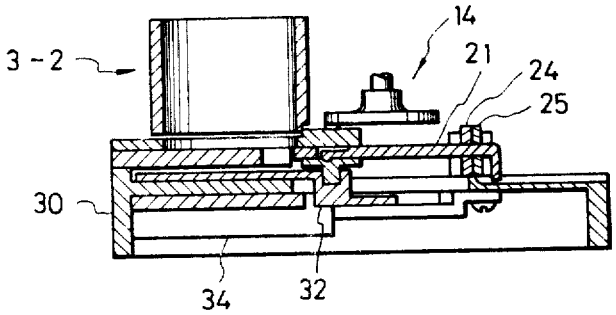

When the pay out slide 10 is positioned as shown in FIG. 6, the coin tubes 3-1 through 3-4 are over the holes $11a_1$ through $11a_4$, with slight air gaps therebetween as shown in FIGS. 11 through 13, respectively. In this case, the coins 40 through 43 at the bottoms of the coin tubes 3-1 through 3-4 are received in the holes $11a_1$ through $11a_4$, respectively, and are supported on the base plate 31. The positional relationships between the holes $11a_1$ through $11a_4$ of the pay out slide 10 and the cuts 31*a* of the base plate 31 are as shown in FIG. 6. Therefore, the coins in the holes $11a_1$ through $11a_4$ are supported on the base plate 31 as described above.

Under the conditions shown in FIG. 6, the wipers 32 and 33 are locked as shown in FIG. 7. More specifically, the locking parts 32*c* and 33*c* of the wipers 32 and 33 are locked by the protruded strip 30*g* of the tongue 30 of the bottom base 30, and the arm parts 32*a* and 33*a* are along the circumference of the hole 34*b* in such a manner that the arm parts hold the hole 34*b* from both sides thereof.

The change levers 24 and 25 are positioned as shown in FIG. 6 when the solenoids 26 and 27 are not energized, but they are moved a predetermined distance in the direction of the arrow C when the solenoids are energized. The positional relationships between the holes $24c_1$ through $24c_4$ of the change lever 24 and the holes $25c_1$ through $25c_4$ are as indicated in the part (a) of FIG. 8. More specifically, only the holes 24*c*, and $25c_1$ are aligned with each other, and the centers of these holes $24c_1$ and $25c_1$ are aligned with the center $O_1$ of the groove 301, but the remaining holes are not aligned with one another. In this case, only the change slide 20 can pass through the holes $24c_1$ and $25c_1$, and the remaining change slide 21 through 23 cannot pass through the holes $24c_2$ through $24c_4$ and the holes $25c_2$ through $25c_4$.

When only the solenoid 26 is energized, only the change lever 24 is moved in the direction of the arrow C. In this case, the positional relationships between the holes of the change lever 24 and the holes of the change lever 25 are as shown in the part (b) of FIG. 8, and only the holes $24c_2$ and $25c_2$ are aligned with each other. Accordingly, only the change slide 21 can pass through the holes $24c_2$ and $25c_2$.

When both of the solenoids 26 and 27 are energized, both of the change levers 24 and 25 are moved in the direction of the arrow C. In this case, the positional relationships between the holes of the change lever 24 and the holes of the change lever 25 are as indicated in the part (c) of FIG. 8, and only the holes $24c_3$ and $25c_3$ are aligned with each other. Therefore, only the change slide 22 can pass through these holes $24c_3$ and $25c_3$.

When only the solenoid 27 is energized, the change lever 25 is moved in the direction of the arrow C. In this case, the positional relationships of the holes of the change levers 24 and 25 are as shown in the part (d) of FIG. 8, and only the holes $24c_4$ and $25c_5$ are aligned with each other. Therefore, only the change slide 23 can pass through the holes $24c_4$ and $25c_4$.

The solenoids 26 and 27 are driven by signals from a control circuit (not shown).

The arrangement of the coin dispensing machine is as described above. In the normal state of the coin dispensing machine, or when the machine is not dispensing coins, the coin dispensing machine 2 is stopped in its state as shown in FIG. 6.

Figure 8:
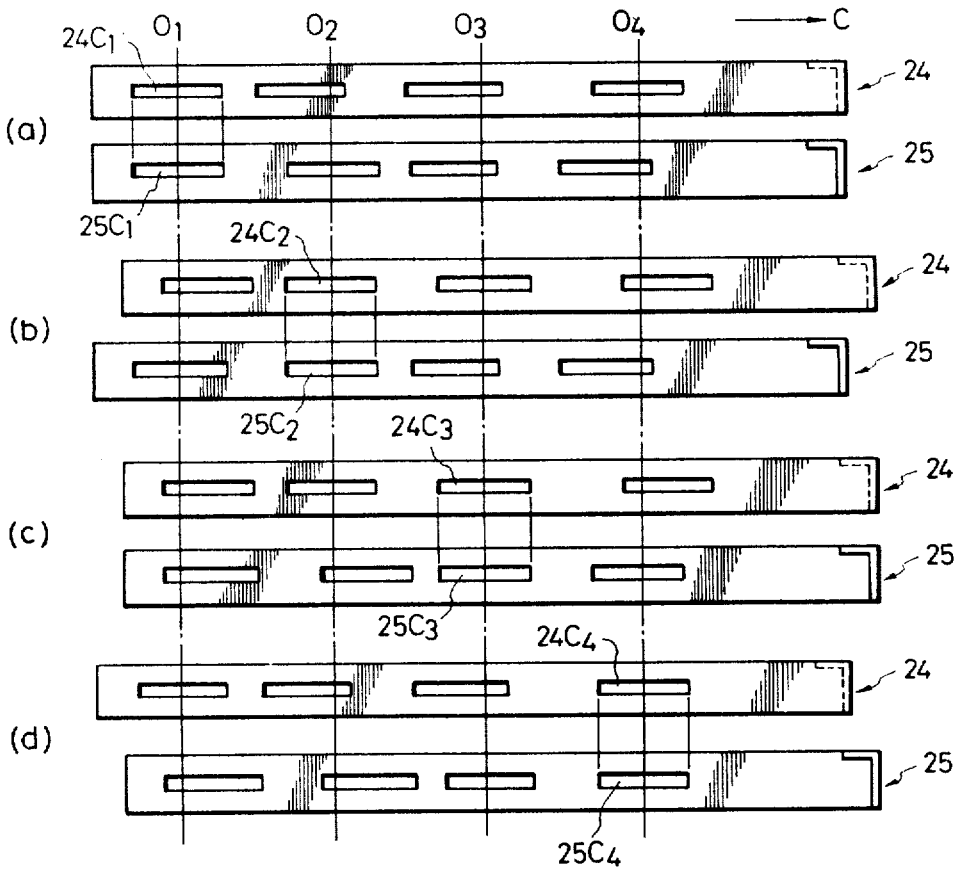
FIG. 8 is a diagram for a description of the operation of change levers.

Now, it is assumed that the coin dispensing operation is started and the came 13 and 14 are turned clockwise and counterclockwise, respectively, and that the solenoids 26 and 27 are not energized yet and the change levers 24 and 25 are positioned as shown in the part (a) of FIG. 8. In this case, as the cams 13 and 14 are turned, the pay out slide 10 is slide in the direction of the arrow B on the base plate 31. In this operation, as the change slides 20 through 23 are locked in the holes 11*e* of the pay out slide 10 as shown in FIG. 13, the change slides 20 through 23 tend to follow the movement of the pay out slide 10.

However, in this case, the change levers 24 and 25 are as shown in the part (a) of FIG. 8, and only the holes $24c_1$ and $25c_1$ are aligned with each other. Therefore, only the change slide 20 can pass through the holes $24c_1$ and $25c_1$ of the change levers 24 and 25. Accordingly, the change slide 20, following the movement of the pay out slide 10, is moved in the direction of the arrow B. On the other hand, the remaining change slides 21, 22 and 23 cannot pass through the holes in the change levers 24 and 25, that is, they cannot move in the direction of the arrow B. As the pay out slide is moved in the direction of the arrow B, the protruded strips (not shown) of the tongues 21*b* through 23*b* (FIG. 2) of the change slides 21 through 23 are lifted from the engaging grooves 12*b* of the pay out slide 10, as a result of which the change slides 21 through 23 are disengaged from the pay out slide 10. Thereafter, these change slides 21 through 23 are held at positions as shown in FIG. 6. In this operation, the protrusion 11*b* of the pay out slide 10 is moved along the hole 31*b* of the base plate 31, and therefore the pay out slide 10 is slid correctly in the direction of the arrow B without staggering on the base plate 31.

The wiper 32 and 33 follow the movement of the pay out slide 10, thereby causing the shaft parts 32*b* and 33*b* to move in the direction of the arrow B along the holes $30d_1$ and $30d_2$, as shown in FIG. 7. Thus, as the locking parts 32*c* and 33*c* are abutted against the protruded strip 30*h*, the wipers 32 and 33 are turned in the directions of the arrows G and H around the protrusions $12a_1$ and $12a_2$ (FIG. 2) of the pay out slide 10 which have been inserted into the holes 32*d* and 33*d*, respectively.

The coins 40 through 43 in the holes $11a_1$ through $11a_4$ of the pay out slide 10, following the movement of the pay out slide 10, are slid on the base plate 31 in the direction of the arrow B. As was described above, the change slide 20 follows the movement of the pay out slide 10, but the remaining change slides 21 through 23 do not. Therefore, being moved in the direction of the arrow B, the coin 40 is gradually dropped from the base palate 31 onto the upper surface 30*a* of the bottom base 30. On the other hand, the coins 41 through 43 are shifted from the base plate 31 onto the change slides 21 through 23, and are then slid on the change slides 21 through 23, respectively.

Figure 9:
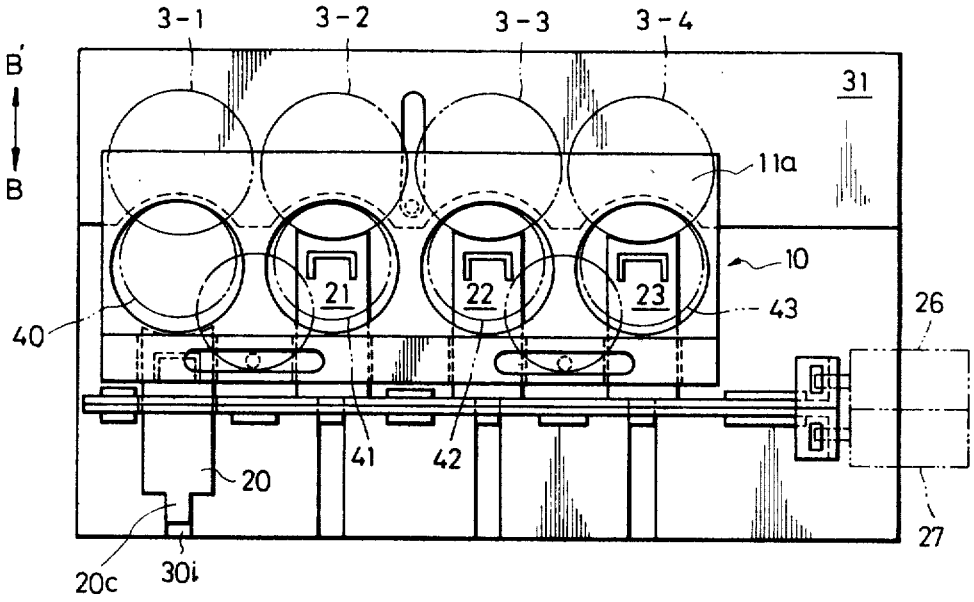
FIGS. 9 and 10 are diagrams for a description of the operation of the machine shown in FIGS. 6 and 7, respectively.
Figure 10:
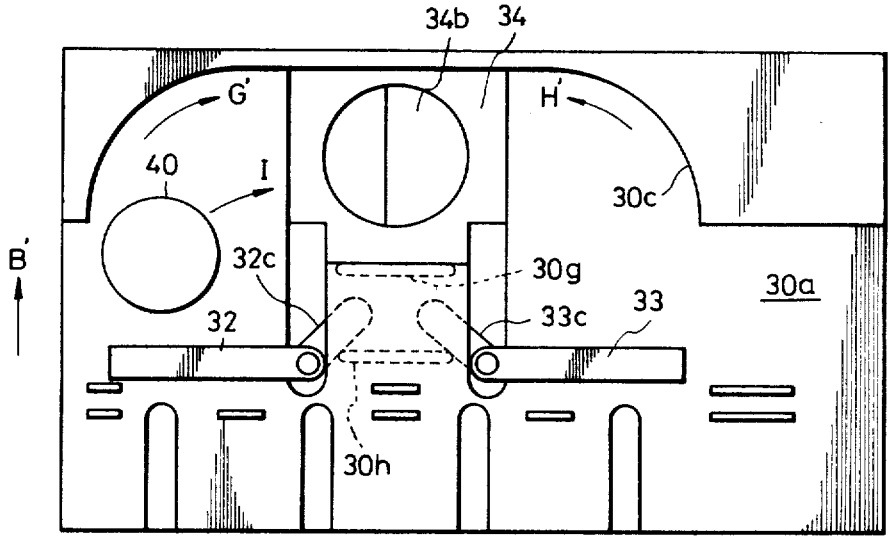

When the cams 13 and 14 have been turned through 180 degrees, the pay out slide 10 is moved to the position shown in FIG. 9. The shift position of the pay out slide 10 at this instant is its maximum shift position in the direction of the arrow B. Under this condition, the coin 40 has been dropped on the bottom base upper surface 30*a*, and the remaining coins 41 through 43 are on the change slides 21 through 23. In addition, the coin tubes 3–1 through 3–4 are at positions indicated by the chain lines. Accordingly, the coins (not shown) contained in these coin tubes are on the flat plate 11*a* of the pay out slide 10; that is, they are supported by the flat plate 11*a*. The wipers 32 and 33 are disposed as shown in FIG. 10.

As the cams 13 and 14 are further turned, the pay out slide 10 is moved now in the direction of the arrow B'. The wipers 32 and 33, following the movement of the pay out slide 10, are moved in the direction of the arrow B'. When the locking parts 32*c* and 33*c* are abutted against the protruded strip 30*g*, the wipers 32 and 33 are turned in the directions of the G' and H' while moving in the direction of the arrow B', respectively. Simultaneously, the arm part 32*a* of the wiper 32 slides the coin on the upper surface 30*a* of the bottom base in the direction of the arrow I (FIG. 10). The change slide 20, following the movement of the pay out slide 10, is moved in the direction of the arrow B'. Furthermore, the coins 41 through 43 on the change slides 21 through 23, following the movement of the pay out slide 10, are slid from the change slides 21 through 23 onto the base plate 31 in the direction of the arrow B'.

When each of the cams 13 and 14 makes one revolution, the pay out slide 10 is returned to its initial position as shown in FIG. 6, and simultaneously another coin is dropped from the coin tube 3–1 into the hole 11*a*$_1$ of the pay out slide 10. However, the coins 41 through 43 in the holes 11*a*$_2$ through 11*a*$_4$ are pushed back to their lowest positions in the coin tubes. Then, the protruded strips (not shown) of the tongues 21*b* through 23*b* of the change slides 21 through 23 are dropped into (engaged with) the respective grooves 12*b* (FIG. 2), whereby the change slides are engaged with the pay out slide 10 again.

On the other hand, the wipers 32 and 33 are moved to the positions as shown in FIG. 7, to push the coin 40 into the hole 34*b* of the coin detector 34. As a result, the coin 40, sliding along the sloped surface, drops through the hole 34*b* and is then discharged into a returning outlet (not shown) through a coin passage (not shown). The coil 35 detects the coin 40 passing through the hole 34*b* to output a signal which is applied to the control circuit (not shown).

Thus, the dispensation of the coin 40 has been completed.

In the case where the solenoid 26 is energized when the coin dispensation is started, only the change lever 21 follows the movement of the pay out slide 10, and the coil 41 in the hole 11*a*$_2$ is dispensed similarly as in the above-described case.

Similarly, when the solenoids 26 and 27 are energized, the coin 42 in the hole 11*a*$_3$ is dispensed; and when solenoid 27 is energized, the coin 43 in the hole 11*a*$_4$ is discharged. In this connection, the solenoid 26 and/or the solenoid 27 is maintained energized for the time interval which elapses from the start of the coin dispensation until at least one dispensation is completed.

Thus, the coins are dispensed one after another through one hole to a predetermined number of pieces separately according to the monetary denominations.

Figure 14:
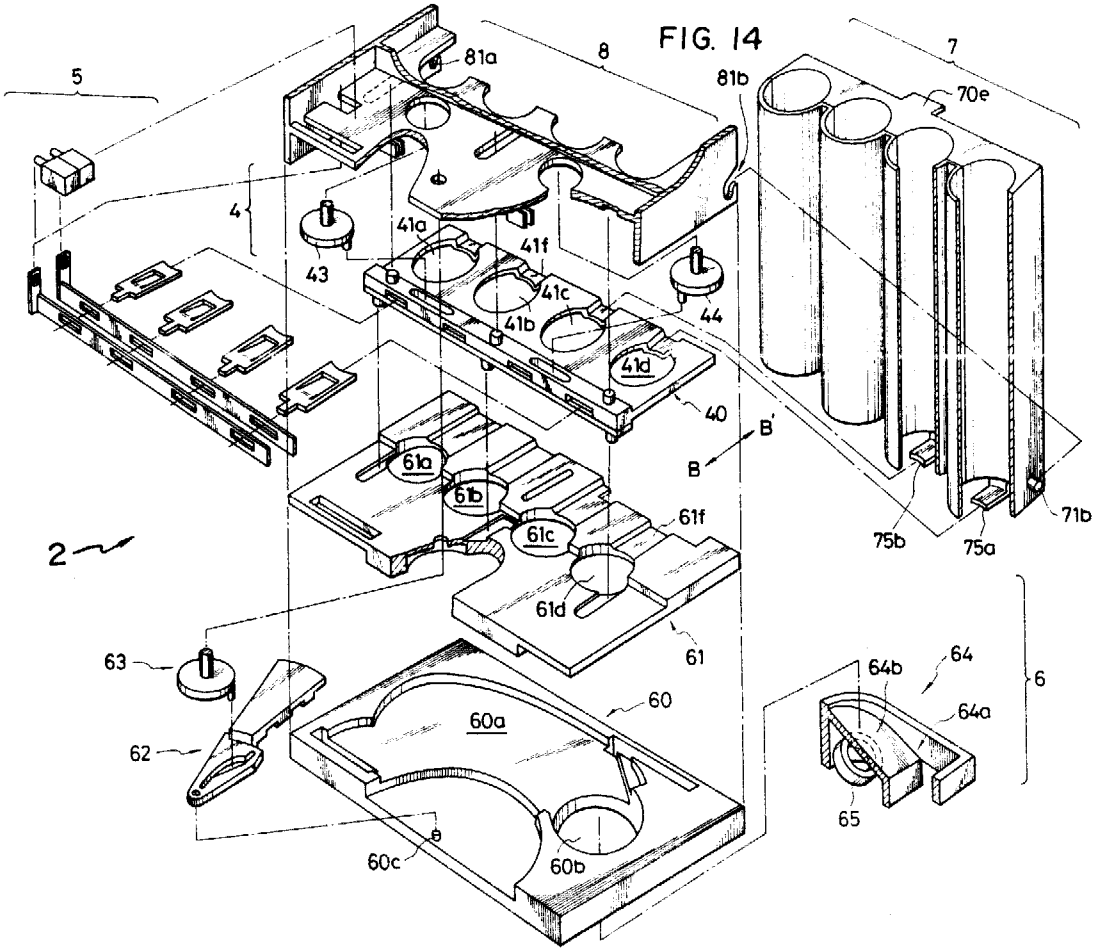
FIG. 14 is a perspective view, partly cut away, showing another example of the coin dispensing machine according to the invention.

Another example of the coin dispensing machine according to the invention is shown in FIG. 14. In this example, coins taken out onto the surface 60*a* of a bottom base 60 are swept in one direction by one wiper 62 at all times. Coin tubes are formed as one unit that is a cassette type coin tube 7 which can be detachably mounted on the body of the coin dispensing machine. The coin dispensing machine comprising a coin taking-out mechanism section 4, a coin selection control section 5 and a coin dispensing mechanism section 6 which are substantially similar to those shown in FIG. 2.

Figure 17:
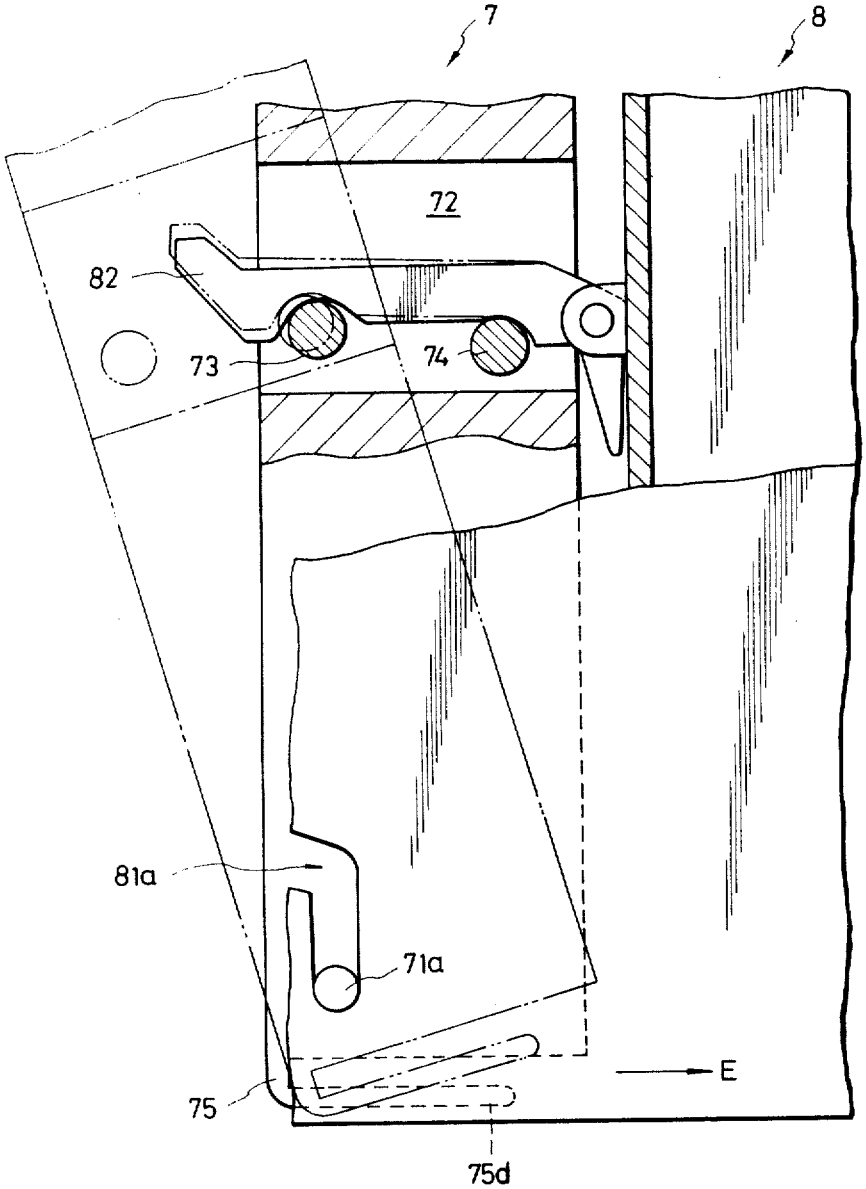
FIG. 17 is a diagram for a description of the engagement and disengagement of the cassette type coin tube shown in FIG. 16.

The cassette type coin tube 7 (herein after referred to as "a coin tube body 7" when applicable) has a plurality of, for instance four, holes 70*a* through 70*d*, each forming a coin tube for containing change coins. Protrusions 71*a* and 71*b* are provided on the lower portions of both sides of the coin tube body 7, and a through hole 72 is formed in the upper portion of a wide wall of the body 7. Provided in the hole 72 are shafts 73 and 74 (FIG. 17). The coin tube body 7 has a supporting member 75 at the lower end portion thereof. The supporting member 75 is to support the coins in the coin tubes with its coin supporting parts 75*a* through 75*d* (FIGS. 14 and 17, 75*c* and 75*d* not shown). The coin supporting parts 75*a* through 75*d* are disposed substantially at the centers of the holes 70*a* through 70*d*, respectively, and the lengths and widths the coin supporting parts are suitably determined for supporting the coins. The distance between each of the coin supporting parts 75*a* through 75*d* and each of the holes 70*a* through 70*d* is slightly longer than the thickness of the respective coins so that only the coin at the bottom of each coin tube (70*a* through 70*d*) can be slid in a predetermined direction (or in the direction of the arrow E in FIG. 17) so as to be taken out of the coin tube.

A housing 8 is provided for the coin tube body 7 so that the latter 7 can be detachably mounted on the machine. The housing 8 is placed on the coin taking-out mechanism section 4. The housing 8 has slots 81*a* and 81*b* out in the lower portions of two opposite side walls 80*a* and 80*b* thereof.

A mounting lever 82 is to engage the housing with the coin tube body 7. The lever 82 has a locking part 82*a* in the lower portion of which a recess 82*c* is cut so that the recess 82*c* can engage the aforementioned shaft 73 or 74. Bearing members 83 and 84 are provided on a wall 80*c* of the housing 80, and a spring 85 is provided between the bearing members 83 and 84 so that the lever 82 can be swung elastically downwardly.

When the coin tube body 7 is combined with the housing 8, the protrusions 71*a* and 7*b* are inserted into the slots 81*a* and 81*b* of the housing 80, respectively, and the locking part 82*a* of the lever 82 is inserted into the through hole 72 (FIG. 17). In this case, the recess 82*c* of the locking part 82 engages the shaft 73, and the locking part 82 is maintained abutted against the shaft 73 by means of the spring 85. Therefore, the coin tube body 7 is locked with the housing 8 at the upper and lower portions thereof (FIG. 17).

In order to supply coins into the coin tube body 7, it is necessary to lift the end portion of the lever 82. As a result, the recess 82*c* is disengaged from the shaft 73, while the pushing part 82*b* of the lever 82 pushes the coin tube body 7. Accordingly, the coin tube body 7 is turned outwardly around the protrusions 71*a* and 71*b* provided on both sides of the coin tube body 7, as a result of which the upper portion of the coin tube body 7 is pushed out of the housing.

Figure 16:
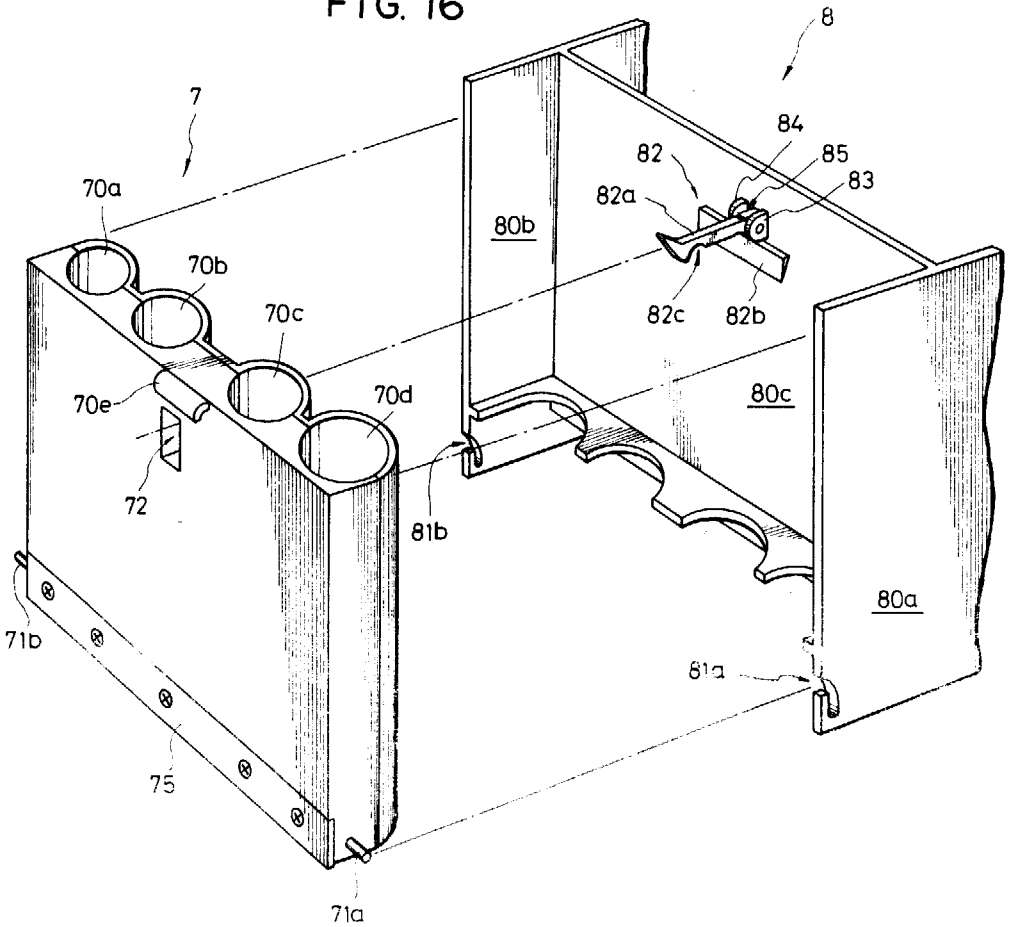
FIG. 16 is a perspective view showing one example of a cassette type coin tube used in the coin dispensing machine shown in FIG. 14.

Then, the knob 70*e* of the coin body 7 is pulled forward (FIG. 14 and FIG. 16). As the recess 82*c* is engaged with the shaft 74 during this knob pulling operation, the coin tube body 7 is locked (as indicated by the chain lines in FIG. 17). Under this condition, the holes 70*a* through 70*d* are open obliquely upwardly outside the housing 8, and accordingly it can be performed to charge coins thereinto.

The coin tube body 7 can be removed from the housing as follows: First, the knob 70*e* is further pulled forward to allow the shaft 74 to disengage from the recess 82*c* of the lever 82 to pull the lever 82 out of the through hole 72. Then, the coin tube body 7 is pulled forward while being lifted, so as to remove the protrusions 71*a* and 71*b* from the slots 81*a* and 81*b*. Thus, the coin tube body 7 can be removed from the housing 8.

Holes 41*a* through 41*d* formed in a pay out slide in the coin taking-out mechanism section 4 are open through recesses 41*f* at the rear edge thereof. The supporting members 75*a* through 75*d* of the coin tube body 7 are inserted into the recesses 41*f*, respectively. The pay out slide 40 is slid in the direction of the arrow B or B' by means of cams 43 and 44. A coin dispensing outlet 60*b* is cut in the surface 60*a* of a bottom base 60.

A wiper 62 is rotatably supported by a shaft 60*c* on the bottom base 60. The wiper 62 is turned in the direction of the arrow D or D' along the surface 60*a* of the bottom base 60 thereby to introduce a coin dropped on the surface 60*a* to the coin dispensing outlet 60*b*. The pay out slide 40 and the wiper 62 are driven individually with the predetermined timing.

An annular detecting coil 65 is provided below the bottom 64*b* of a detector 64. This arrangement is considerably effective for preventing detection error. The hole 64*a* of the detector 64 is aligned with the hole 60*b* of the bottom base 60, below bottom base 60, and is then secured to the bottom base 60.

Figure 15:
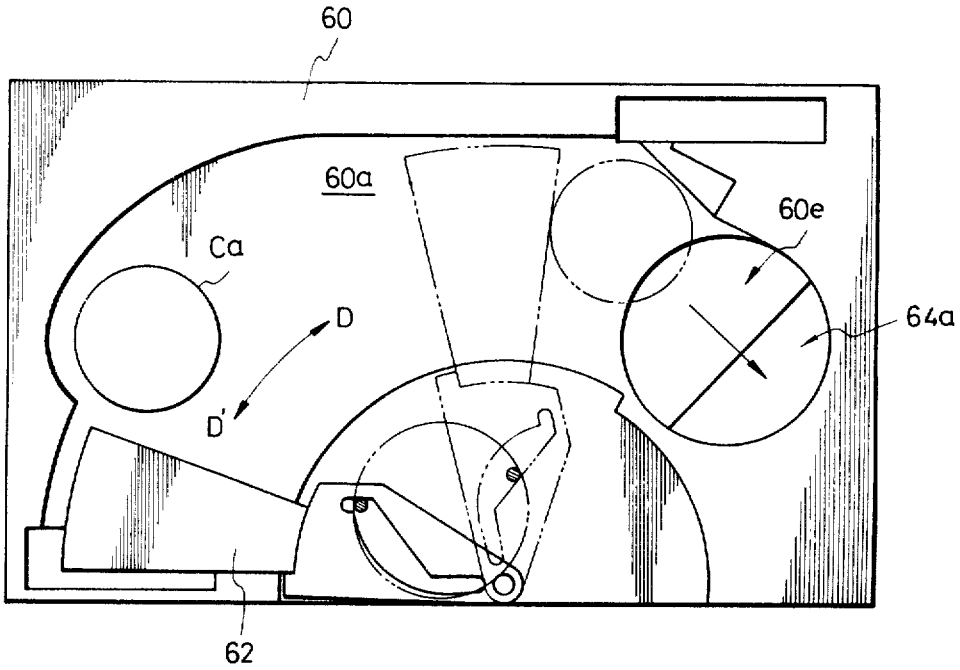
FIG. 15 is a diagram for a description of the operation of the machine shown in FIG. 14.

A coin Ca is taken out of the coin tube body 7 and is dropped onto the surface 60*a* of the bottom base 60. The coin Ca is moved to the hole 60*b* by the wiper 62 and is then dispensed through the hole 64*a* of the detector (FIG. 15).

In the above-described example, the coin detector is provided on the bottom base of the coin dispensing mechanism section; however, the invention is not limited thereto or thereby; that is, the provision of the detector is not always necessary, and the coin dispensing outlet may be merely provided at a suitable position in the bottom base.

Furthermore, in the above-described examples, the coin dropped through the hole of the pay out slide is temporarily supported by the bottom base and is then moved to the coin dispensing outlet by the wiper; however, the invention is not limited thereto. That is, the bottom base and the wipers may be eliminated so that the dispensing coin dropped through the hole of the pay out slide is introduced directly to the coin returning outlet.

What is claimed is:

1. A coin dispensing mechanism comprising:

a plurality of parallel coin tubes;

coin removal means for temporarily removing coins located at the bottom of said tubes, said coin removal means comprising:

a base plate disposed below said coin tubes, a pay out slide plate located between the base plate and the bottoms of said coin tubes, said pay out slide including holes to receive coins from the coin tubes; and reciprocating drive means for initially moving the pay out slide plate in a direction generally perpendicular to the coin tubes and subsequently returning the pay out slide plate to its original position;

coin selection control means for supporting all but a selected one of the removed coins in the coin removal means, said coin selection control means including a plurality of movable platforms corresponding to said coin tubes for selectively supporting the removed coins and means for controlling the movement of the platforms; and coin dispensing means for dispensing said selected coin from the coin dispensing machine.

2. A coin dispensing mechanism as defined in claim 1 wherein said coin tubes are detachable from said coin removal means and the respective coin tubes have lower coin supporting members for supporting coins thereon.

3. A coin dispensing mechanism as defined in claim 1 wherein said coin tubes are tiltable and are supported in an inclined position when change coins are supplied to the coin tubes.

4. A coin dispensing mechanism according to claim 1 wherein said means for controlling includes a pair of independently slidable bars, each of said bars including a plurality of openings within which an end of each of said platforms is supported, wherein the platforms are releasably coupled to the pay out slide plate and moved thereby, and wherein the bars are slidable to align the openings so that only a selected one of the platforms can pass therethrough, whereby when said pay out slide plate is initially moved, the non-selected platforms will remain stationary and support the coins in the holes and the selected platform will be moved through the aligned openings and the selected coin will drop out of its corresponding hole into the coin dispensing means.

5. A coin dispensing mechanism according to claim 1 wherein said coin dispensing means includes a bottom member located beneath the base plate and onto which the selected coin falls, an outlet and at least one wiper rotating over the bottom member, said wiper sweeping dropped coins from the bottom member to the outlet.

6. A coin dispensing mechanism according to claim 5 wherein said wiper arm is slidable and rotatable over said bottom member, whereby after a coin has been dropped onto said bottom member said wiper arm will initially slide along the bottom member and subsequently rotate to sweep coins to the outlet.

7. A coin dispensing mechanism according to claim 6 wherein said wiper arm is coupled to said base plate and wherein the motion of the wiper arm is controlled by the motion of the base plate.

8. The coin dispensing mechanism of claim 2 including a housing having a pair of slots located on opposite walls thereof, wherein said tubes are connected together and include protrusions which fit within the slots, said mechanism further including a latch for securing the tubes in a fixed position within the housing.

9. The coin dispensing mechanism of claim 1 wherein said coin dispensing means includes a coin detector for detecting the passage of coins.

10. A coin dispensing mechanism comprising:

a plurality of parallel coin tubes;

a support plate located beneath the coin tubes for supporting coins in the tubes;

a slide plate, located between the bottom of the coin tubes and the support plate and including a hole corresponding to each coin tube, for temporarily removing coins from the bottom of the coin tubes;

a plurality of movable platforms, located below the slide plate and corresponding to each hole, for supporting coins in the openings; and control means for controlling the movement of the platforms, said control means including a pair of independently slidable bars, each of said bars including a plurality of openings through which an end of each of said platforms can extend, wherein the platforms are releasably coupled to the slide plate and are moved thereby, and wherein the bars are slidable to align the openings so that only a selected one of the platforms can pass therethrough, whereby when said slide plate is moved, the nonselected platforms will decouple from the slide plate and remain stationary so as to support the coins in the holes and the selected platform will be moved through the aligned openings and the coin will drop out of its corresponding hole.

11. In a coin dispensing mechanism of the type which includes a plurality of parallel coin tubes, a support member located below the coin tubes for supporting coins in the coin tubes and a slide plate located between the coin tubes and support member and movable to temporarily remove a coin from the bottom of each tube, said slide plate including a plurality of coin receiving holes, one corresponding to each coin tube, the improvement for dispensing one of said removed coins comprising:

a plurality of platforms, located beneath the slide plate and substantially coplanar with the support member, for supporting the removed coins, said platforms being coupled to the slide plate to be moved thereby; and selective stop means for decoupling all but one of the platforms from the slide plate and stopping movement of the decoupled platforms, whereby as the slide plate moves the openings will be moved over the stopped platforms and all but one of the removed coins supported thereby, said one remaining platform being moved by the slide plate so that the coin in the corresponding opening in the slide plate will not be supported.

12. A coin dispensing machine comprising:

a plurality of coin tubes disposed in parallel;

coin taking-out means for taking out coins located at the bottoms of said coin tubes;

coin selection control means for dropping a coin to be dispensed among the taken out coins on a bottom base and returning the remaining coins to the bottoms of said coin tubes, said coin selection control means including a plurality of movable change slides for temporarily supporting the coins received therein, a plurality of change levers for controlling the movements of the change slides, and at least a pair of solenoids for selectively moving the change levers individually; and coin dispensing means for introducing the dropped coin to an outlet of the coin dispensing machine.

13. A coin dispensing machine as defined in claim 12 wherein said coin taking-out means comprises:

a pay out slide, located between a base plate disposed below said coin tubes and the lower ends of said coin tubes, said pay out slide having holes to receive the coins placed at the bottoms of said coin tubes; and drive means for reciprocating said pay out slide in a direction normal to the direction in which said coin tubes are parallelly disposed;

wherein said change slides are provided on a side of the base plate on which the coins are taken out and support the coins in said pay out slide hole by hole when said pay out slide is displaced in a direction in which the coins are taken out, said coin selection control means further including locking means for engaging said change slide with said pay out slide, and wherein said change levers are each engaged with one end of each of said change slides for selectively allowing and blocking the sliding movement of said change slides, said solenoids driving said change levers in accordance with the types of the coins to be dispensed.

* * * * *